US006461103B2

(12) United States Patent
Kim

(10) Patent No.: US 6,461,103 B2
(45) Date of Patent: Oct. 8, 2002

(54) SIROCO FAN OF A WINDOW TYPE AIR CONDITIONER

(75) Inventor: Sung-Chun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/854,692

(22) Filed: May 15, 2001

(65) Prior Publication Data

US 2001/0043861 A1 Nov. 22, 2001

(30) Foreign Application Priority Data

May 16, 2000 (KR) ..... 00-26214

(51) Int. Cl.[7] ..... F04D 29/28

(52) U.S. Cl. ..... 415/53.1; 416/185; 416/223 B; 416/DIG. 2

(58) Field of Search ..... 415/53.1; 416/243, 416/DIG. 5, 185, 187, 223 B, DIG. 2

(56) References Cited

U.S. PATENT DOCUMENTS 3,394,876 A * 7/1968 Eck ..... 415/206
4,165,950 A * 8/1979 Masai et al. ..... 416/178
4,900,228 A * 2/1990 Yapp ..... 416/183
4,915,583 A * 4/1990 Vera et al. ..... 415/204
5,586,053 A * 12/1996 Park ..... 416/178
6,287,078 B1 * 9/2001 Min et al. ..... 416/189

* cited by examiner

*Primary Examiner*—F. Daniel Lopez
*Assistant Examiner*—Igor Kershteyn
(74) *Attorney, Agent, or Firm*—Birch, Stewart, Kolasch & Birch, LLP

(57) ABSTRACT

A siroco fan of a window type air conditioner, in which the rotational speed can be increased without changing the quantity of the blowing air and without increasing the operational noise, thereby improving the marketability of the air conditioner. The siroco fan has a shroud and a plurality of blades disposed at the shroud and spaced apart at regular intervals, each of the blades having a trailing edge angle of 125° to 137°, a leading edge angle of 58° to 63°, a chord-to-pitch ratio of 0.75 to 0.85, an inner diameter-to-outer diameter ratio of 0.82 to 0.86, and a maximum camber position of 0.3 to 0.4 of a chord length of the blade.

4 Claims, 3 Drawing Sheets

| Scroll width | 105 | 97 |
|---|---|---|
| RPM | 752 | 940 |
| Noise | 41.4 | 49 |

| Trailing edge angle | 146 | 136 | 130 | 126 |
|---|---|---|---|---|
| Camber position | 0.4 | 0.3 | 0.25 | 0.25 |
| Noise | 752 | 800 | 855 | 898 |
| Noise | 41.4 | 41.8 | 42.7 | 43.1 |

| Scroll width | 105 | 97 |
|---|---|---|
| RPM | 752 | 940 |
| Noise | 41.4 | 49 |

SIROCO FAN OF A WINDOW TYPE AIR CONDITIONER

BACKGROUND OF THE INVENTION

1. Field of the Invention

The present invention relates to a siroco fan, and more particularly to a siroco fan employed in a window type air conditioner, which does not increase the noise of operation while maintaining the quantity of the blowing air, even when the rotational speed of the siroco fan is increased.

2. Description of the Related Art

In general, a window type air conditioner has a casing 10, which contains a compressor 12 for compressing refrigerant, a condenser 14 for condensing the refrigerant compressed by the compressor 12 to lower the temperature of the refrigerant, and an evaporator 16 for performing a heat exchange operation by means of the refrigerant cooled by the condenser 14.

The interior of the window type air conditioner is divided into an indoor section and an outdoor section by a partitioning panel 18. In the indoor section are disposed the evaporator 16 and a siroco fan 20 for circulating indoor air through the siroco fan 20, while in the outdoor section are disposed the compressor 12, the condenser 14, and an axial-flow fan 30 for cooling the condenser 14 by means of outdoor air.

The siroco fan 20 is disposed behind a bell mouth 11 in the casing 10. The siroco fan 20 includes a shroud 21 and a plurality of blades 22 disposed at the shroud 21 which are spaced apart at regular intervals, as shown in FIG. 2. In order to reduce the dimension and manufacturing cost of the air conditioner, the siroco fan 20 and the axial-flow fan 30 are disposed in such a manner as to be operated together by a single driving motor 40. In this case, a rotation shaft 41 of the driving motor 40 has opposite ends assembled with the siroco fan 20 and the axial-flow fan 30, respectively.

In the window-type air conditioner as described above, warm indoor air is cooled while being introduced through the evaporator 16 and the bell mouth 11 in the casing 10. The introduced air is compressed by the blades 22 of the siroco fan 20 and then discharged out of the casing 10, so that the indoor air is properly cooled or air-conditioned. In this case, the refrigerant warmed after exchanging heat with the warm air at the evaporator 16 is cooled by outdoor air introduced into the outdoor section by means of the operation of the axial-flow fan 30, while passing through the condenser 14. The refrigerant is then circulated while performing its heat-exchange operation.

The blowing characteristic of the siroco fan 20 is influenced by such features as the number of blades 22, the blade span B, the inner diameter $d_1$ of the siroco fan 20, which is the distance between the opposing inner ends of the blades 22, and the outer diameter $d_2$ of the siroco fan 20, which is the distance between the opposing outer ends of the blades 22.

The number of the blades 22 is determined by the ratio between the chord L1, which is the distance between the inner end and the outer end of each blade 22, and the pitch L2, which is the distance between the adjacent two outer ends of the blades 22, as shown in FIG. 3*a*.

Furthermore, the blowing characteristic of the siroco fan 20 is also influenced by the shape of the blades 22, which is determined in consideration of the leading edge angle β, the trailing edge angle α, the blade thickness T, and the largest camber position P, as shown in FIG. 3*b*. The trailing edge angle α is a factor causing an increase in the static pressure, and the fan can perform superior blowing capability when the trailing edge angel α is in a range between 145° and 165°.

In the meantime, the axial-flow fan 30 has a smaller quantity of blowing air in comparison with the siroco fan 20, based on the same motor output. Accordingly, in the case where the siroco fan 20 in the indoor section rotates together with the axial-flow fan 30 in the outdoor section by utilizing a single driving motor outputs of the siroco fan and the axial flow fan will be different. In consideration of the above difference in the quantity of blowing air from the respective fans, the rotational speed of the driving motor 40 should be set above a predetermined reference, so that the axial-flow fan 30 having the smaller blowing capability can perform the necessary blowing capability.

Accordingly, in the window type air conditioner containing a conventional siroco fan as described above, since the rotating speed of the siroco fan is very high, the quantity of the indoor air blown by the siroco fan exceeds the cooling capability of the evaporator, making the operation of the air conditioner ineffective and inefficient In the prior art, in order to overcome the above problem of ineffective operation of the air conditioner, the outer diameter $d_2$ of the siroco fan 20 between the opposed outer ends of the blades 22 is reduced, or the blade span B is reduced.

However, according to these two ways of either reducing the outer diameter or the blade span, although the quantity of the blowing air is reduced, the modified construction of the blade 22 generates increased noise, thereby causing a deterioration in the marketability of the air conditioner.

SUMMARY OF THE INVENTION

Accordingly, the present invention has been made in an effort to solve the problems occurring in the related art, and thus it is an object of the present invention to provide a siroco fan in a window-type air conditioner which does not increase the noise of operation while maintaning the quantity of the blowing air, even when the rotational speed of the siroco fan is increased.

In accordance with one aspect of the present invention, there is provided a siroco fan for a window-type air conditioner, the siroco fan comprising a shroud and a plurality of blades disposed at the shroud and spaced apart in regular intervals, wherein each of the blades has a trailing edge angle of 125° to 137°, a leading edge angle of 58° to 63°, a chord-to-pitch ratio of 0.75 to 0.85, an inner diameter-to-outer diameter ratio of 0.82 to 0.86, and a maximum camber position of 0.3 to 0.4 of a chord length of the blade. Preferably, the siroco fan has forty to fifty blades.

BRIEF DESCRIPTION OF THE DRAWINGS

The above objects, and other features and advantages of the present invention will become more apparent after a reading of the following detailed description when taken in conjunction with the drawings, wherein.

DETAILED DESCRIPTION OF PREFERRED EMBODIMENTS

Figure 1:
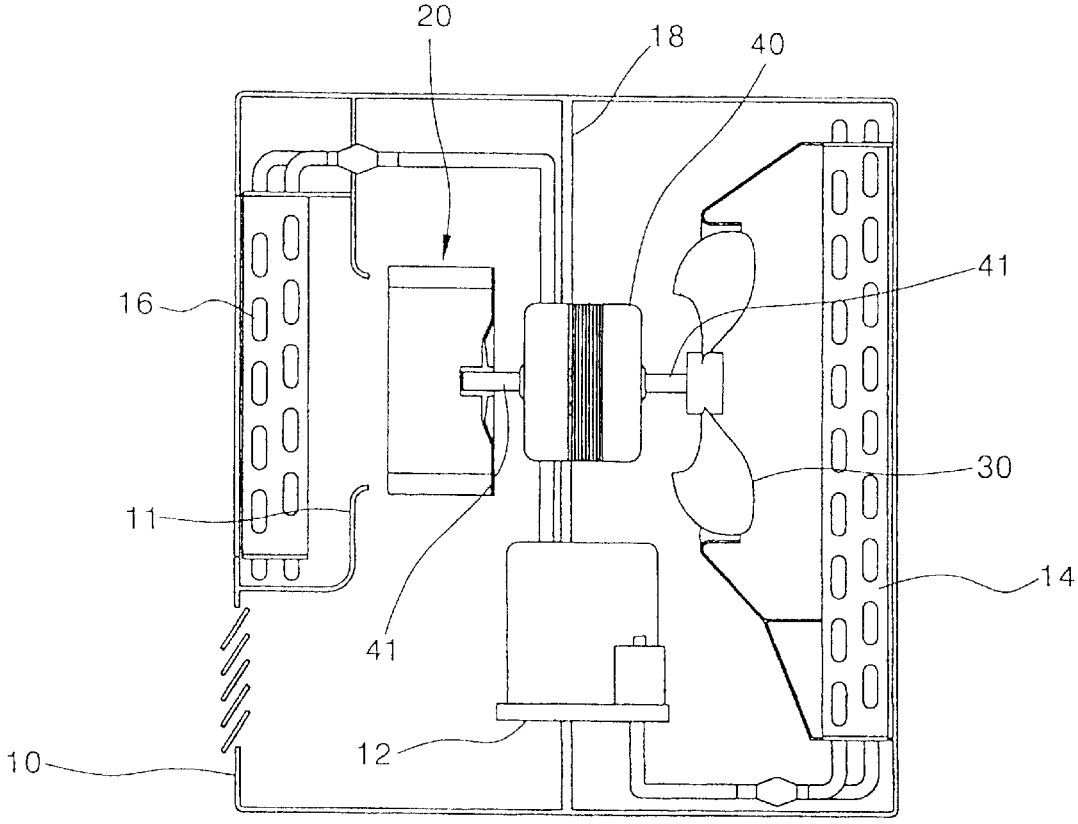
FIG. 1 is a schematic sectional view of a conventional window type air conditioner showing the construction thereof.
Figure 2A:
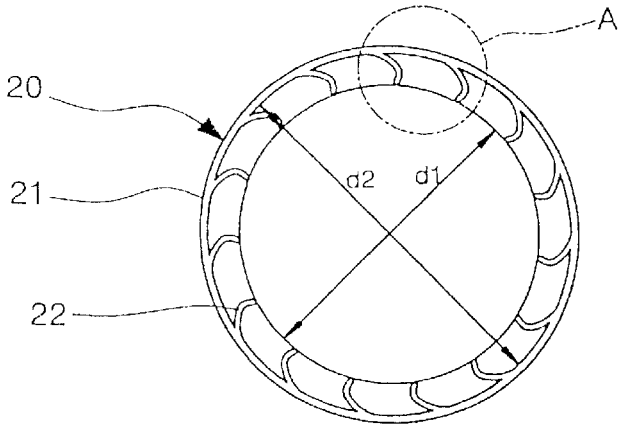
FIGS. 2(*a*) and 2(*b*) are schematic views showing transverse and longitudinal sections of a conventional sirocco fan employed in the window type air conditioner shown in FIG. 1.
Figure 2B:
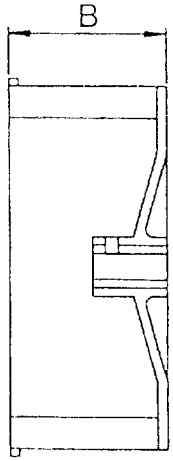
Figure 3A:
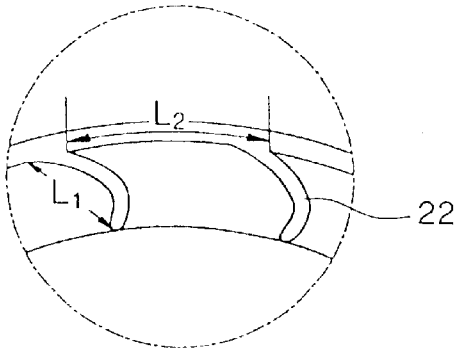
FIGS. 3*a* and 3*b* are enlarged views of the circled portion A in FIG. 2.
Figure 3B:
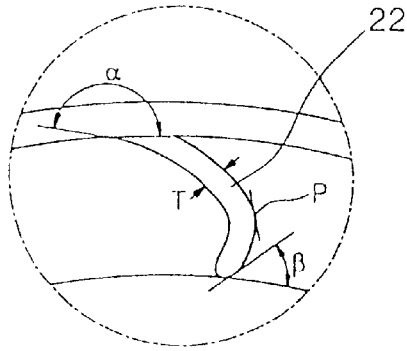

The above and other objects, characteristics, and advantages of the present invention will become apparent from the following description taken with the accompanying drawings, in which the same elements contain the same reference numerals throughout the various views.

Figure 4:
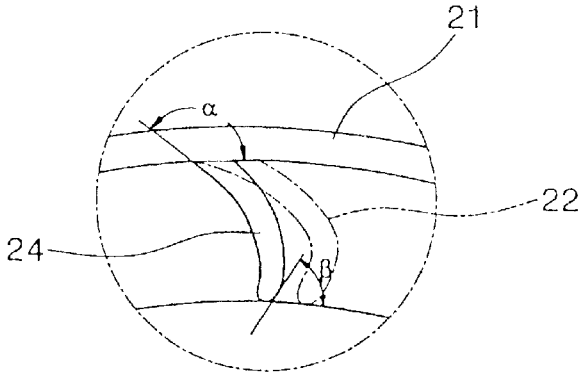
FIG. 4 is an enlarged view of a blade of a siroco fan for a window-type air conditioner according to an embodiment of the present invention, which can be compared with the blade of the prior art as shown in FIGS. 3*a* and 3*b.
Figure 5:
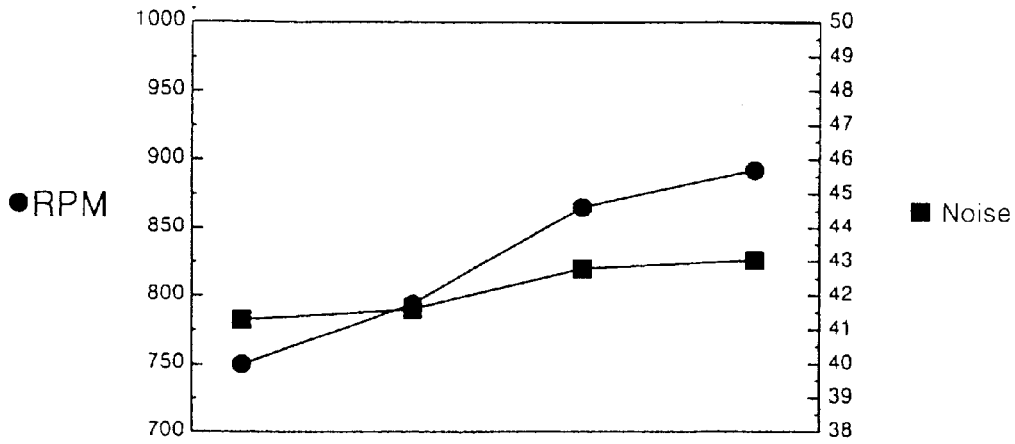
* and FIGS. 5 and 6 are graphs showing the results of experiments using a siroco fan in a window type air conditioner according to an embodiment of the present invention.
Figure 6:
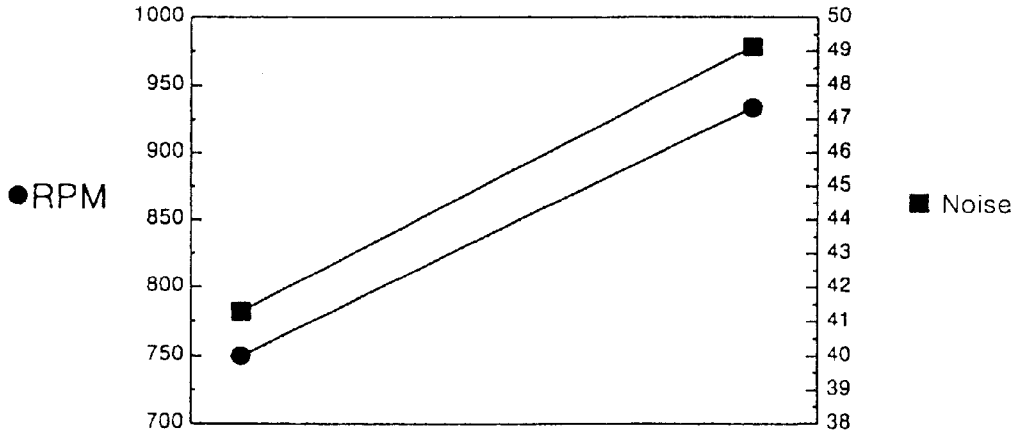

Referring to FIGS. 4 to 6, a siroco fan for a window-type air conditioner, according to an embodiment of the present invention, includes a shroud 21 and a plurality of blades 24 disposed at the shroud 21 and spaced apart at regular intervals. Further, each of the blades 24 is shaped in such a manner as to have a trailing edge angle $\alpha$ of 125° to 137°, a leading edge angle $\beta$ of 58° to 63°, a chord-to-pitch ratio $L_1/L_2$ of 0.75 to 0.85, an inner diameter-to-outer diameter ratio $d_1/d_2$ of 0.82 to 0.86, and a maximum camber position P of 0.3 to 0.4. of a chord length of the blade. FIG. 4 clearly shows the difference between the blade 24 of the present invention drawn by a solid line and the blade 22 of the prior art drawn by a phantom line.

Further, the siroco fan according to the present embodiment includes about forty to about fifty blades 24.

The fan according to the present embodiment generates reduced operational noise in comparison with the prior art, in which the blade span is decreased in order to increase the rotational speed while maintaining the quantity of the blowing air.

Hereinafter, more detailed description will be given, on the basis of results of experiments.

A siroco fan having forty eight blades 24 is provided, each having a trailing edge angle $\alpha$ of 126°, a leading edge angle $\beta$ of 60.5°, an inner diameter of 140.5 mm, an outer diameter of 162 mm, and a camber position P of 0.3. As a result of an experiment using a siroco fan having the shape as described above, the rotational speed and the noise level were measured as 898 rpm and 43.1 dB, when the quantity of blowing air is 6 $m^3$/min.

On the other hand, in an experiment using a siroco fan having conventional blades, the rotational speed and the noise level was measured as 752 rpm and 41.4 dB, when the quantity of blowing air is 6 $m^3$/min.

In the case where the blade span is decreased by about thirteen percent according to the prior art in order to increase the rotational speed without changing the quantity of the blowing air, the rotational speed was measured to be increasing to 910 rpm as shown in FIG. 6. However, the noise level was measured to be as large as 48.5 dB at a distance of one meter, which is at least 7 dB larger than that of the siroco fan of the present invention.

Therefore, in the siroco fan for a window-type air conditioner according to the present invention, the operational noise is not increased in the case where the rotational speed of the siroco fan is increased according to the increase of the rotating speed of the axial flow fan, without changing the quantity of blowing air.

In the siroco fan for a window type air conditioner according to the present invention, the rotational speed can be increased without changing the quantity of the blowing air and without increasing the operational noise, thereby improving the marketability of the air conditioner.

While there have been illustrated and described, the preferred specific embodiments of the present invention, it will be understood by those skilled in the art that the present invention is not limited to the specific embodiments thereof, and thus various changes and modifications and equivalents may be substituted for various elements without departing from the spirit and scope of the present invention.

What is claimed is:

1. A siroco fan comprising:

a shroud, and a plurality of blades disposed at the shroud said blades being spaced apart at regular intervals, wherein each of the blades has a trailing edge angle of 125° to 137°, a leading edge angle of 58° to 63°, a chord-to-pitch ratio of 75 to 0.85, an inner diameter-to-outer diameter ratio of 0.82 to 0.86, and a maximum camber position of 0.3 to 0.4 of a chord length of the blade.

2. The siroco fan as claimed in claim 1, containing about forty to fifty blades.

3. A window-type air conditioner containing a siroco fan, said fan comprising:

a shroud, and a plurality of blades disposed at the shroud said blades being spaced apart at regular intervals, wherein each of the blades has a trailing edge angle of 125° to 137°, a leading edge angle of 58° to 63°, a chord-to-pitch ratio of 0.75 to 0.85, an inner diameter-to-outer diameter ratio of 0.82 to 0.86, and a maximum camber position of 0.3 to 0.4 of a chord length of the blade.

4. The window-type air conditioner of claim 3, wherein said siroco fan contains about forty to fifty blades.

* * * * *